US007488260B2

(12) United States Patent
Moorehead et al.

(10) Patent No.: US 7,488,260 B2
(45) Date of Patent: Feb. 10, 2009

(54) GOLF BALL PASSING ELEPHANT MINIATURE GOLF COURSE HAZARD

(76) Inventors: Elizabeth Ann Moorehead, 8206 Sandalwood Cv, Austin, TX (US) 78757; Jeffry Thomas Russell, 8206 Sandalwood Cv, Austin, TX (US) 78757

( * ) Notice: Subject to any disclaimer, the term of this patent is extended or adjusted under 35 U.S.C. 154(b) by 1493 days.

(21) Appl. No.: 10/272,801

(22) Filed: Oct. 18, 2002

(65) Prior Publication Data

US 2004/0077429 A1 Apr. 22, 2004

(51) Int. Cl.
*A63B 57/00* (2006.01)

(52) U.S. Cl. ..... 473/173; 473/158

(58) Field of Classification Search ..... 473/151, 473/158–160, 173, 180; 273/317.2, 395, 273/397; D21/790
See application file for complete search history.

(56) References Cited

U.S. PATENT DOCUMENTS 5,197,738 A * 3/1993 Hartman, Sr. ..... 473/158

FOREIGN PATENT DOCUMENTS

FR 2637191 A * 4/1990

OTHER PUBLICATIONS

English translation of French Patent No. 2637191, 8 pages.*

* cited by examiner

*Primary Examiner*—Dmitry Suhol
*Assistant Examiner*—Alex F. R. P. Rada

(57) ABSTRACT

A miniature golf course device that is in the shape of an elephant. An internal frame provides support for a ball guide with moving parts and an external body covering. A golf ball enters the trunk opening, the pivoting trunk is raised, and the golf ball travels through the interior of the elephant. The ball exits the rear end to simulate the elephant pooping the ball. The trunk is raised by operating a tail lever. Operation of the tail lever is accompanied by visual and acoustic effects.

16 Claims, 5 Drawing Sheets

GOLF BALL PASSING ELEPHANT MINIATURE GOLF COURSE HAZARD

FEDERALLY SPONSORED RESEARCH

Not applicable.

SEQUENCE LISTING

Not applicable.

BACKGROUND

1. Field of Invention

The present invention relates to a miniature golf course game, specifically to a device used as an hazard.

2. Description of Prior Art

As is well known and understood, wide varieties of obstacles for miniature golf course hazards exist. Some may take the fixed form of humps and curves in a putting surface while others may take the static form of openings in a designed apparatus through which a golfer attempts to putt a ball. As is also well known and understood, many such miniature golf course obstacles incorporate dynamic elements such as moving barriers, for example the blades of a windmill turning in the path of a ball. Innovations of late essentially have been made only in the decor and environs of the course layout—such as jungle motifs or space motifs.

Many hazards feature geometric shaped obstacles or variations in course surface. U.S. Pat. No. 5,749,789 to Karl (1996) discloses a course featuring circular and rectangular obstacles. U.S. Pat. No. 3,912,275 to Hagelberg (1975) discloses an obstacle that can be varied between plays, but still features only geometric openings and/or obstacles. U.S. Pat. No. 2,974,958 to O'Herron (1961) discloses a two-part apparatus, one with an opening and one a curved barrier, which can be configured to create an obstacle that still only features geometric shapes. A number of U.S. Design Patents, such as D255,821 to Goransson (1980), D210,838 to Cox, et al. (1968) and D202,990 to Ganger (1965), disclose surface variations or geometric surface obstacles. All these hazards lack the engaging and entertaining nature of an obstacle that resembles an animal or other character. Furthermore, these obstacles do not provide for transport of the ball through the obstacle.

Hazards intended to represent entertaining or unusual obstacles are embellished with ornamental features that support a motif, but are not functional. U.S. Pat. No. D350,989 to Lanier (1994) discloses a static obstacle in the form of a crutch. U.S. Pat. No. D83,529 to Fazekas (1930) discloses an obstacle in the shape of a large frog. Such static, non-functional obstacles do not engage the participant to interact with the obstacle.

U.S. Pat. No. 5,197,738 to Hartman, Sr. (1993) discloses a transparent miniature golf course hazard that transports a ball through an obstacle. Based on an entry hole into the obstacle, the ball is electromechanically propelled through different, observable paths with various exit points from the obstacle. While this obstacle provides entertainment by allowing the participant to observe the path of the ball, it does not provide an opportunity for the game participant to interact with the apparatus. The ball transport path features Rube Goldberg-type arrangements, which does not lend itself to use in a motif that features an animal or other characters.

Obstacles that incorporate moving parts typically strive to place an oscillating barrier in the path of the ball, an example of which is the well-known windmill obstacle. U.S. Pat. No. 2,497,390 to Anthony (1950) discloses a mechanically driven oscillating hazard member that is interposed between the path of the ball and the receiving holes. In addition to requiring electrical power, such hazards are more a source of frustration than entertainment, as the main purpose is to impede advancement of the ball towards the hole.

U.S. Pat. Nos. 3,575,559 and 3,645,536 to Tierney (1971) disclose an apparatus that plays a sound or message when a ball is knocked into one or more channels. The circuitry that plays the message is triggered by the ball rolling over a sensor. Though entertaining, such an acoustic effect is not specifically coordinated with features of the obstacle. Nor does this apparatus operate in response to any immediate player interaction with a device, only to a ball rolling over a sensor. The apparatus also lacks any coordinated or accompanying visual effects. Such apparatus do not provide the opportunity for a player to manually interact with the hazard such that a ball advances toward the hole.

Objects and Advantages

Accordingly, besides the objects and advantages of the miniature golf hazard described in the specification, several objects and advantages of the present invention are:

(a) to provide a hazard shaped like an elephant, or any other suitable animal, such that a golf ball enters a feature shaped like a trunk, the ball is transported through the obstacle itself, and the ball exits the hazard as if the hazard pooped the ball;

(b) to provide a hazard with features that are placed in motion when the device is activated;

(c) to provide a hazard whereby movement of the ball is manually powered by the player;

(d) to provide a hazard with visual and acoustic sound effects coordinated with operation of the device;

(e) to provide a functional hazard that engages the participant by requiring operation of the device to advance the ball;

(f) to provide a hazard that transports the ball between disjoint sections of the miniature golf course; and (g) to provide a hazard with moving parts that advances the ball towards the hole, rather than impeding progress in the form of a barrier.

Further objects and advantages of the invention will become apparent from a consideration of the drawings and ensuing description.

SUMMARY

In accordance with the present invention, a miniature golf course hazard comprises a mechanism embedded in a replica of an elephant such that a golf ball enters the trunk and exits the rear-end of the elephant to the accompaniment of visual and sound effects.

DRAWINGS

Drawing Figures

Reference Numerals in Drawings

Figure 2:
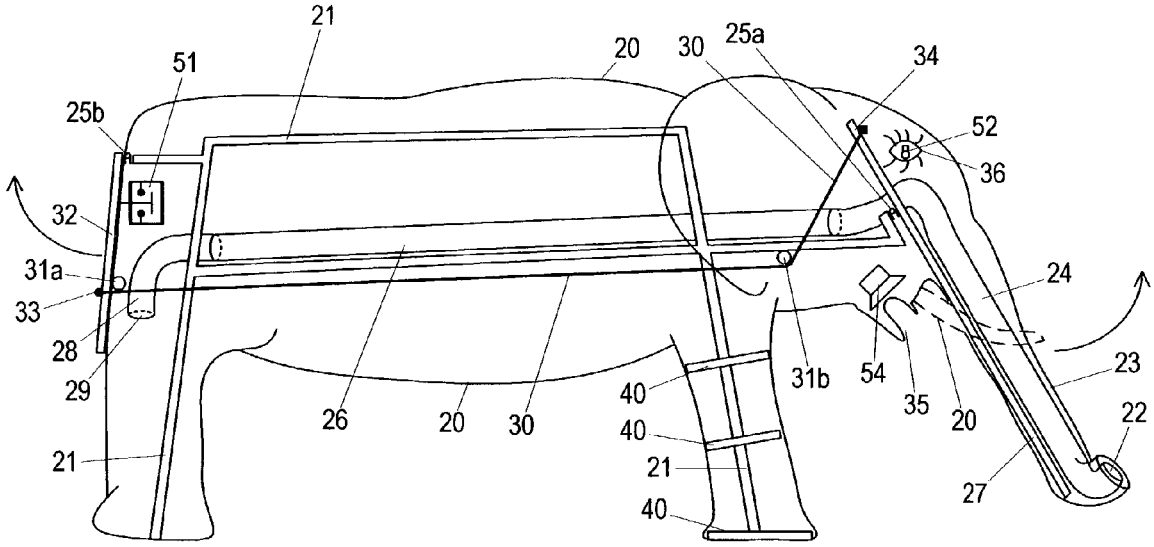
FIG. 2 shows a longitudinal section of the invention with the mechanism for transporting a ball.
Figure 3:
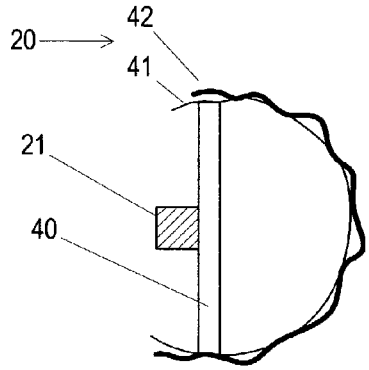
FIG. 3 shows a cross-section of the support elements for the body covering.
Figure 6:
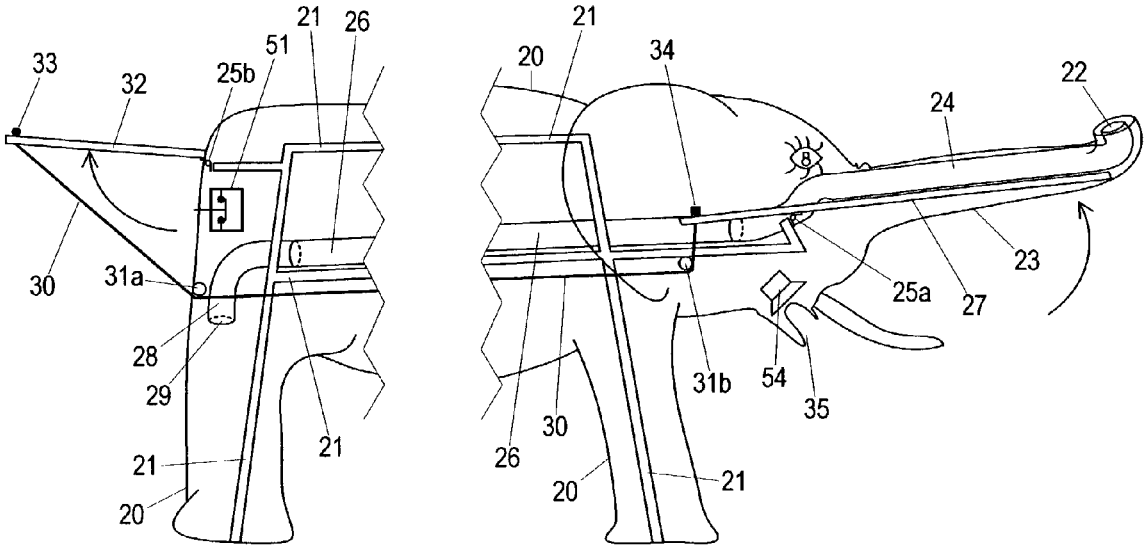
FIG. 6 shows the trunk and tail position when the device is activated.

2 Section line indicating view of FIG. 2
3 Section line indicating view of FIG. 3
6 Section line indicating view of FIG. 6
10 Elephant obstacle device
11 Miniature golf course
12 Starting section
13 Final section
14 Target hole
15 Golf ball
20 Body covering
21 Frame
22 Trunk opening
23 Trunk portion of elephant shape
24 Flexible trunk ball guide
25*a* Trunk hinge
25*b* Tail hinge
26 Main ball guide
27 Trunk frame support
28 Rear curved ball guide
29 Ball exit opening
30 Rope
31*a* Pulley
31*b* Pulley
32 Tail lever
33 Rear rope attachment point
34 Trunk rope attachment point
35 Mouth feature in body
36 Eye feature in body
38 Electric motor winch of additional embodiment
39 Normally open switch of additional embodiment
40 Frame member for body covering
41 Body covering subsurface supporting material
42 Body covering surface finish material
50 Visual and acoustic effects circuit
51 Normally open electric switch
52 Light emitting device
53 Sound playback subsystem
54 Speaker
55 Power supply
60 Motor
61 Linkage

DETAILED DESCRIPTION

Description—FIGS. 1, 2, 3, 4, 5—Preferred Embodiment

Figure 1:
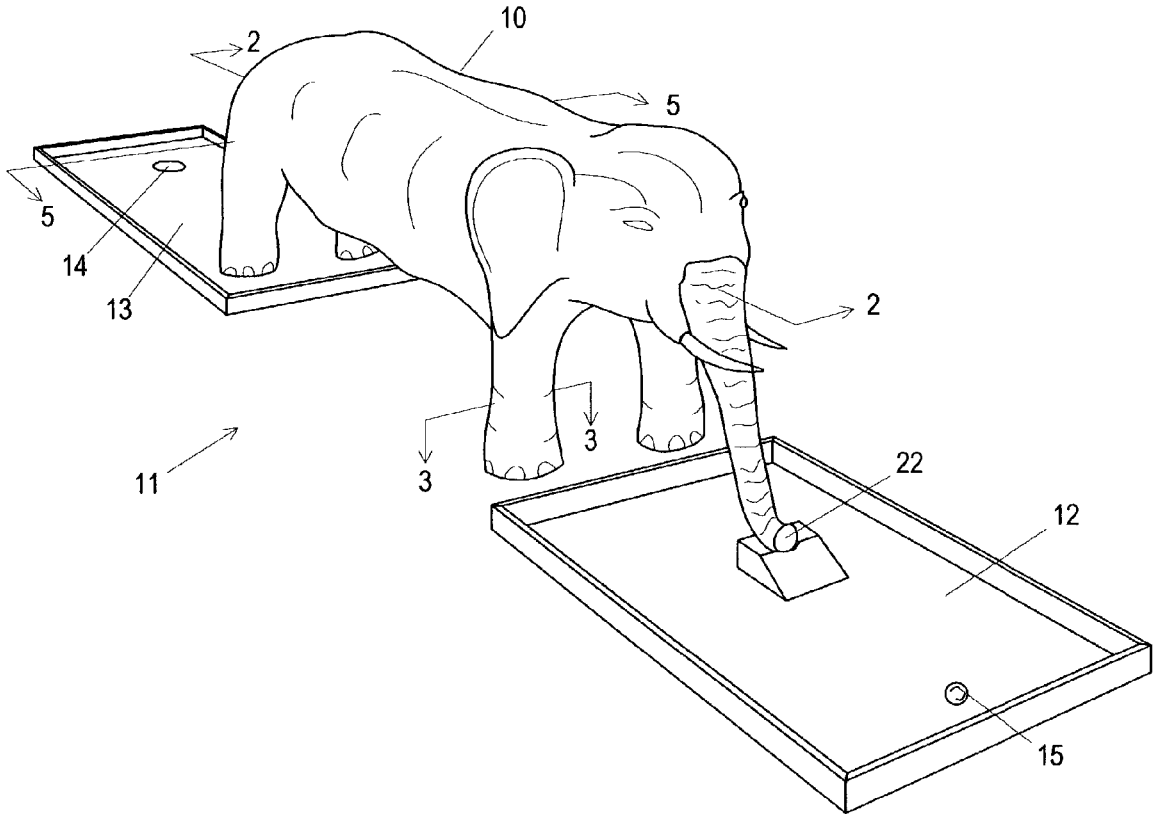
FIG. 1 shows a perspective view of the device in a miniature golf course.

FIG. 1 shows a perspective view of an elephant obstacle or hazard device 10 as situated in a typical miniature golf course 11. As used here, a miniature golf course consists of a single tee-off area and a channel, possibly containing hazards or obstacles, along which a golf ball 15 is directed towards one, final target hole. Various internal mechanisms of the elephant obstacle device 10 are hidden from view by the shape of an elephant. Though not specifically part of the elephant obstacle, the golf course hole 11 illustrates how the elephant obstacle is oriented to be an obstacle that transports the golf ball 15 from a starting section 12 to a final section 13 with a target hole 14. The golf ball 15 is directed into a trunk opening or inlet 22 in the elephant obstacle device 10 and exits from the anatomic rear-end or tail portion of the elephant obstacle device 10 as if it were pooped out. As used here, the verb poop is means to defecate. A line 2--2 indicates the section view of FIG. 2. A line 3--3 indicates the section view of FIG. 3. A line 5--5 indicates the section view of FIG. 5.

FIG. 2 shows a longitudinal section view of the elephant obstacle device 10. A body covering 20 enclosed a frame 21 and associated mechanisms that transport a ball. A plurality of body support elements 40 is attached to the frame 21 as needed to form the elephant shape of the body covering 20, including anatomical features such as a mouth 35 and two eyes 36. An elephant trunk 23 is formed around a structural trunk support frame 27. A ball enters through the opening 22 in the trunk 23. Internal to trunk 23, a flexible trunk guide, tube, or channel 24 provides a path for a ball from opening 22 to an internal main guide 26. The trunk support 27 for the trunk 23 is attached to the frame 21 using a hinge 25*a*. The trunk support 27 is connected to a flexible tension member, chain, or rope 30 at attachment point 34. The main guide 26 is connected to a rear curved ball guide 28. The curved guide 28 provides a path for a ball from main guide 26 to a ball outlet or exit 29 through the body 20. A rigid lever 32 configured to resemble a tail is attached to the frame 21 at a hinge 25*b*. The tail lever 32 is connected to rope 30 at an attachment point 33. The rope 30 is routed through a plurality of pulleys 31*a* and 31*b*. A normally open switch 51 is controlled by contact with the tail lever 32. A speaker 54 is located near the mouth 35. A light bulb or light emitting device 52 is positioned in the location of each eye 36.

FIG. 3 shows a cross-section view of one of the body frame elements 40 supporting the body covering 20. Only a portion of the circumference of the body covering 20 is illustrated in this view to demonstrate the layered materials. The body covering 20 consists of a subsurface supporting material 41 and a surface finish material 42. The plurality of body frame elements 40 is attached to the frame 21, as needed, to provide the rough shape of the elephant.

Figure 4:
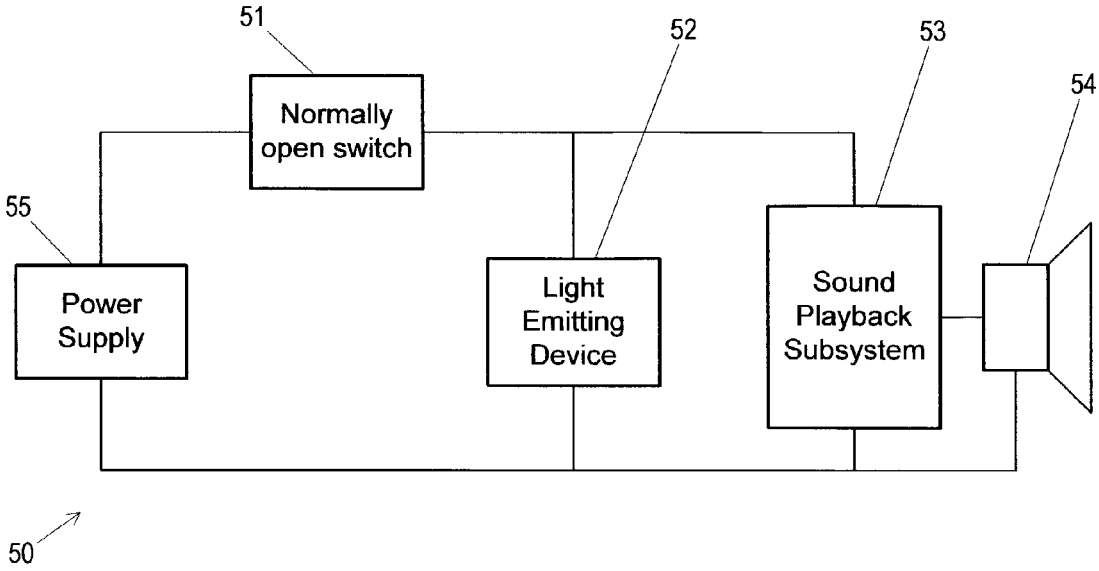
FIG. 4 shows the electric circuit for the visual and acoustic effects.

FIG. 4 shows a circuit 50 used to trigger the visual and acoustic effects. A battery or power source 55 supplies power through switch 51 to the plurality of lights 52 and a sound playback subsystem 53, which in turn drives speaker 54.

Figure 5:
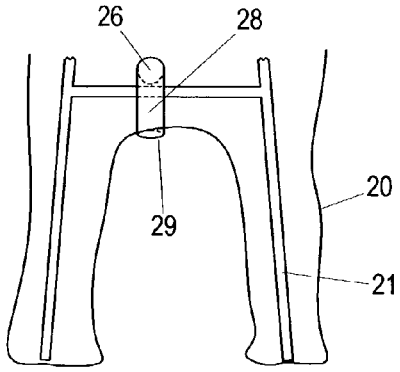
FIG. 5 shows the section view of the rear-end with detail of the ball exit.

FIG. 5 shows a partial cross-section view of the rear end of the elephant obstacle device 10. The curved guide 28 connects the main guide 26 to the ball exit 29. The ball exit 29 protrudes from an opening in the body covering 20. The curved guide 28 is position off-center, as needed, based on the specific implementation of the frame 21 and tail lever 32.

The frame 21 provides the structural support for the device. One embodiment of frame 21 is a plurality of steel tubes welded together. An alternate embodiment is a wooden frame properly reinforced at the joints. The frame 21 is formed to serve several main purposes. Frame 21 supports the ball guides 24, 26, 29 such that a ball can travel from trunk opening 22 to ball exit 29. Frame 21 provides mount points for the trunk hinge 25*a* and the tail hinge 25*b* with sufficient clearance to accommodate the required range of motion. Frame 21 implements the general shape of the elephant. The frame is not limited to serve only these purposes. Alternate materials may be used as dictated by budget, desired strength, or intended size of the obstacle.

The tail lever 32 is a frame for body cover 20 of the tail configuration and provides the structural support between the rope 30 attachment point 33 and the pivot point of tail hinge 25*b*. The tail hinge 25*b* attaches tail lever 32 to the frame 21.

The trunk support frame 27 is a frame for body cover 20 of the trunk configuration and provides the structural support for the flexible guide 24. The trunk support frame 27 is attached at the pivot point of the trunk hinge 25*a*. The trunk hinge 25*a* attaches the trunk support frame 27 to the frame 21.

The ornamental features and shape of the body covering 20 are formed using the subsurface supporting material 41 and surface finish material 42. The body covering 20 is supported by the plurality of frame members 40. One embodiment of the subsurface supporting material 41 is chicken wire or wire mesh fabric. One embodiment of the surface finish material 42 is a reinforced plastic composite comprised of a woven fiber glass fabric embedded in a cured resin matrix such that it forms a weather-proof covering of the internal mechanism. The surface finish material 42 may be appropriately colored to resemble an elephant by using a pigment in the resin or by painting the finished surface. Movable elements, such as the tail 32 or the trunk 23, are covered with a flexible surface finish material to allow motion. Alternate materials may be used based on budget, desired durability, or required weather resistance.

The ball guides 24, 26, and 28 form a continuous tube or curved cylinder such that when a ball enters through opening 22 it exits only through opening 29. One embodiment implements the main guide 26 with a PVC pipe, a cardboard tube, or a circular duct of diameter sufficient to pass a ball. The main guide 26 is mounted on the frame 21 such that the end attached to flexible guide 24 is higher that the end attached to rear curved guide 28. The flexible trunk guide 24 is implemented as a single piece of semi-rigid flexible aluminum ducting matching the diameter of the main guide 26. Such material allows the curve near opening 22 to be formed. The flexible material of trunk guide 24 is joined to the main guide 26. The flexible material accommodates the motion of the trunk 23 and serves to guide a ball around the frame 21 and hinge 25*a*. The curved guide 28 is implemented using a single piece of semi-rigid flexible aluminum ducting, the same diameter of the main guide 26, to provide proper positioning of the ball exit 29 in relation to the body covering 20 so that the exit approximates the location from which poop exits an elephant. FIG. 5 shows the approximate location of the ball exit 29 in relation to the shape of body covering 20. Other materials may be substituted based on desired budget or available materials.

The normally open switch 51 of the visual and acoustic effect circuit 50 is mounted on the frame 21 near the tail lever 32 such that when the tail lever 32 is at rest, the switch 51 is open. When the tail lever 32 is not in the resting position, the switch 51 is closed. The circuit 50 is energized when the switch is closed. One embodiment of the circuit uses a battery to implement a low voltage power supply 55. The light emitting devices 52 that illuminate the elephant eyes 36 are implemented with low voltage light emitting diodes or light bulbs. One embodiment of the sound playback subsystem is an integrated circuit ISD1100 record/playback device and supporting components. The ISD1100 device is manufactured by Information Storage Devices of San Jose. The sound playback system is loaded with the desired sound effect. The sound playback subsystem drives the speaker 54 located near the elephant mouth 35. Alternate materials may be used based on budget, desired impact of effects, or available power sources.

Operation—FIG. 6

FIG. 6 illustrates activated position of the tail and trunk. Initially, a ball rests in the flexible guide 24 at opening 22. The trunk 23 is raised beyond a horizontal position such that a ball in opening 22 rolls through flexible guide 24 due to gravity into main guide 26. Due to the angle of main guide 26, a ball rolls the length of the main guide 26, and enters the curved guide 28, eventually rolling out of the elephant through ball exit 29. Once a player raises the tail lever 32 with a ball in trunk opening 22, the player observes the elephant pooping a ball after a short time delay determined by the angle of the ball guides 24, 26, and 28. The tail is then returned to the initial position and the elephant is ready for its next use.

As pictured in FIG. 1, the operation of the device that is the elephant obstacle device 10 occurs during the play of a game on the miniature golf course 11, the object of which is to hit the ball 15 into the final hole 14. The golf ball 15 is propelled on the starting section 12 such that it comes to rest in the trunk opening 22. The device is activated by lifting the tail lever 32 such that the trunk 23 is raised, which causes the golf ball 15 to travel through the elephant obstacle device 10 under the force of gravity. The golf ball 15 is apparently pooped out the ball exit 29 onto the final section 13. The particular layout or configuration of the miniature golf course may vary so long as the trunk opening 22 and ball exit 29 are on the course 11.

To begin operation of the elephant device, the player lifts tail 32, which is configured as a second-class lever whose fulcrum is hinge 25*b*. The force due to the operation of the tail 32 is transferred to rope 30 at attachment point 33 on the tail 32. The rope 30, pulleys 31*a*, 32*b*, and frame 21 provide for the transfer of the force from operation of the tail 32 to the trunk support frame 27 at attachment point 34. Trunk support frame 27 is configured as a first-class lever with hinge 25*a* acting as the fulcrum. As the tail 32 is raised, the trunk 23 is raised against the force of gravity. The mechanical advantage of the levers is configured based on desired player effort, size of the elephant, and weight of the materials used to implement the trunk 23 including the flexible guide 24 and trunk frame 27.

Concurrent to the motion of the trunk 23, switch 51 is closed when the tail lever 32 is raised. Switch 51 energizes the visual and acoustic effect circuit 50 that results in lights 52 illuminating the eyes 36 and an appropriate sound effect broadcasting from speaker 54 near mouth 35. One embodiment of an appropriate sound is the trumpeting of an elephant. This sound can be followed, though possibly inappropriate based on local social conduct, by a pooping sound timed to coincide with the exit of a ball.

Description—Additional Embodiment Based on Shape

Additional embodiments of the obstacle device 10 vary the general shape and body covering 20 to form different animals. The equivalent of the pivoting elephant trunk 23 supported by trunk frame 27 with ball opening 22 may be implemented, for example, as the snout of an aardvark, the neck and head of a horse, or the head of a rhinoceros. The basic aspects of the ball transport remain unchanged, however the frame 21, trunk support 27, and ball guides 24, 26, 28 may need to be changed to accommodate the appropriate shape of the body covering 20. The corresponding acoustic effect appropriate to the shape of the animal is used in the sound playback subsystem 53.

Operation—Additional Embodiment

The additional embodiments operate in an analogous manner. The tail lever 32 is lifted, raising the forward snout, neck, or head supported by frame 27 such that gravity moves a ball in opening 22 through the obstacle device 10 to ball exit 29.

Figure 7:
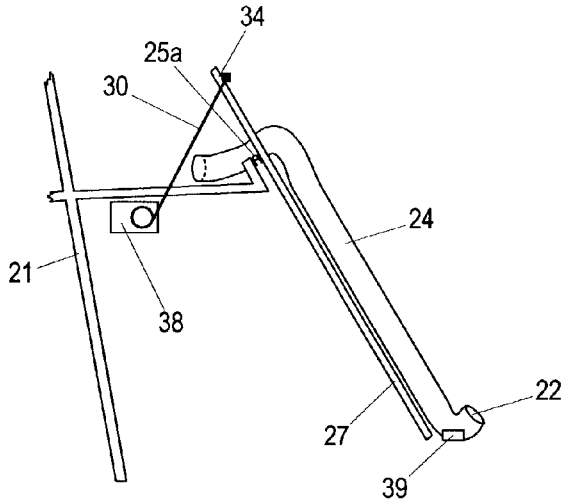
FIG. 7 shows an alternate embodiment using an electric motor winch.

Description—FIG. 7—Additional Embodiment Based on Mechanism

FIG. 7 shows an alternative embodiment of the mechanism to raise the trunk frame 27 using an electric motor winch 38. The rope 30 is attached to the winch 38, which applies the force to the rope attachment 34 to move the trunk frame 27. A normally open electric switch or pressure sensor 39 is configured in the trunk opening 22 to detect the entry of a ball and energize the winch 38.

Figure 8:
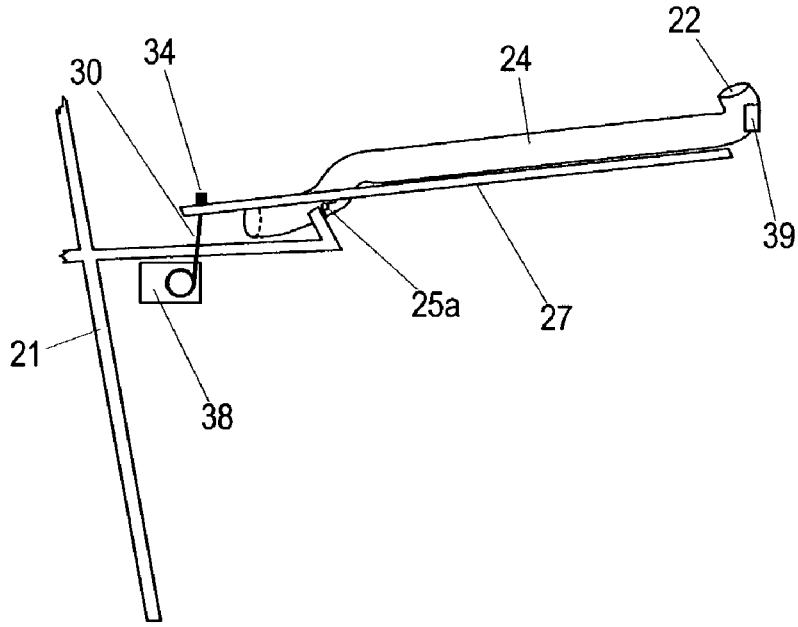
FIG. 8 shows the trunk frame position of the alternate embodiment when activated.

Operation—FIG. 8—Additional Embodiment Based on Mechanism

FIG. 8 shows the activated mechanism for the alternative embodiment shown in FIG. 7. The movement of the trunk is initiated when a ball enters the trunk opening 22 and closes the switch 39 that energizes the winch 38. The winch causes the trunk frame 27 to pivot, raising the trunk frame 27 such that gravity causes a ball to move through the flexible trunk guide 24 to ball exit 29 as previously described in the preferred embodiment.

Figure 9:
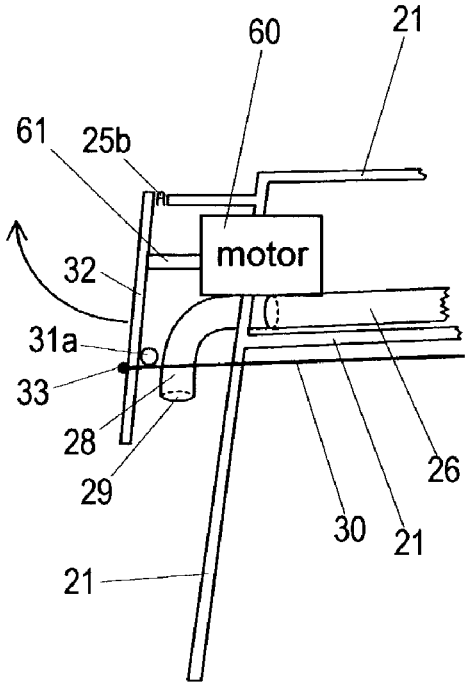
FIG. 9 shows an additional embodiment using an electric motor and linkage.

Description—FIG. 9—Additional Embodiment Based on Tail Mechanism

FIG. 9 shows an alternate embodiment of an automatic mechanism to operate the tail lever 32 using an electric motor 60 attached to tail lever 32 with a linkage 61. The normally open electric switch 39 in the trunk opening 22 energizes motor 60.

Operation—Additional Embodiment Based on Tail Mechanism

The movement of the trunk is initiated when a ball enters the trunk opening 22 and closes the switch 39 that energizes the motor 60. The motor 60, through linkage 61, operates tail lever 32 thereby, raising the forward trunk, snout, neck, or head supported by frame 27 such that gravity causes a ball to move through the flexible trunk guide 24 to ball exit 29 as previously described in the preferred embodiment.

CONCLUSIONS, RAMIFICATIONS, SCOPE

Accordingly, the reader will see that the elephant-shaped device of this invention can be used to implement a novel ball game device. In the preferred embodiment it can be used as a miniature golf course hazard, it can be used to create a miniature golf course obstacle that transports a ball across disjoint course sections, and it can be used to provide visual and audio effects coordinated with the operation of the device. Furthermore, the animal shaped obstacle has the additional advantages in that

- it contains moving parts, yet is shaped like an elephant or any other suitable animal
- it provides an elephant shaped obstacle where the ball exits as if the ball is pooped out, thereby increasing realism;
- it has features that are placed in motion when the device is activated;
- it is manually powered by the player in the preferred implementation;
- it further engages the participant in the game by optionally requiring operation of the device to advance the ball; and
- it implements moving parts that advance the ball towards the hole, rather than impeding progress in the form of a barrier.
- it may be automatic;

Although the description above contains many specificities, these should not be construed as limiting the scope of the invention but as merely providing illustrations of some of the presently preferred embodiments of this invention. For example, the frame can implemented using steel, wood, aluminum, etc.; the circular ball guide channels can be have other cross-section shapes such as square, open, etc.; the ball opening can have other shapes such as oval, the outline of a mouth, etc.; the hinges used to implement the fulcrums may be substituted with a shaft and bearing, etc.

Thus the scope of the invention should be determined by the appended claims and their legal equivalents, rather than by the examples given.

We claim:

1. A ball game device, comprising:

a) a frame shaped to approximate a standing elephant on a surface, said frame having a front-end and a rear-end, b) a tail lever pivotably mounted to the rear-end of said frame, c) a trunk pivotably mounted to the front-end of said frame disposed to touch said surface, d) a body covering of predetermined color and material, e) means for mounting said body covering to said frame and said trunk so as to form the shape of an elephant, f) an opening in said trunk of sufficient diameter to pass a ball, g) a exit opening in rear-end of the shape of the elephant of sufficient diameter to pass the ball, h) a contiguous ball guide of sufficient diameter to pass the ball connecting said trunk opening to said exit opening, i) means for joining said tail lever and said trunk so activation of said tail lever causes said trunk to raise to a sufficient height thereby causing the ball to move from said trunk opening to said rear-end opening under the force of gravity;

whereby the ball is transported through said device to said exit opening.

2. The device of claim 1, further comprising:

a) a visual and acoustic effects circuit of at least:

1. a power supply,
2. a normally open switch disposed near said tail lever so that said switch closes when the tail is moved,
3. at least two light emitting devices of predetermined color,
4. a sound playback subsystem storing a predetermined sound effect,
5. a speaker, b) means for connecting the plurality of said visual and acoustic effects circuit elements thereby energizing said light emitting devices and said sound playback subsystem when said switch is closed;

whereby said light emitting devices are illuminated and said speaker broadcasts a sound from said playback subsystem when said tail lever is moved.

3. A golf device in the shape of an animal comprising:

a) a pivoting trunk portion having an inlet sized for a golf ball, b) a tail portion having an outlet, c) a golf ball guide between said trunk portion and said tail portion, d) a lever on said tail portion for actuation, e) a mechanical linkage between said tail portion to said trunk portion; whereby the actuation of said lever raises said trunk portion, causing a golf ball in said inlet to be transported through said golf ball guide to said outlet.

4. The device of claim 3, further comprising indicators responsive to operation of the lever.

5. The device of claim 4, wherein said indicator is a speaker emitting sound.

6. The device of claim 4, wherein said indicator is a light.

7. The device of claim 3, wherein the animal is an elephant.

8. The device of claim 3, further comprising:

a) a pressure sensor in the inlet, b) a motor, coupled to said pressure sensor and said lever;

wherein said motor is actuated to cause a force to be applied to said lever in response to pressure from a golf ball at said inlet detected by said pressure sensor.

9. The device of claim 8, wherein the amount of actuation force is dependent on the magnitude of pressure detected by the pressure sensor due to the velocity of a golf ball entering at said inlet.

10. A golf device in the shape of an animal comprising:

a) a pivoting trunk portion having an inlet sized for a golf ball, b) a tail portion having an outlet, c) a golf ball guide between said trunk portion and said tail portion, d) a pressure sensor at said inlet, e) a motor, coupled to said pressure sensor, f) a mechanical linkage between said motor and said trunk portion;

whereby said motor raises said trunk portion, causing a golf ball in said inlet to be transported through said golf ball guide to said outlet in response to pressure detected by said sensor.

11. The device of claim 10, further comprising indicators responsive to operation of said motor.

12. The device of claim 11, wherein said indicator is a speaker emitting sound.

13. The device of claim 11, wherein said indicator is a light.

14. The device of claim 10, wherein the animal is an elephant.

15. The device of claim 10, wherein the amount of actuation force is dependent on the magnitude of pressure detected by the pressure sensor due to the velocity of a golf ball entering at said inlet.

16. A method of transporting a golf ball through an obstacle and between two possibly disjoint course sections of a miniature golf game, comprising the steps of:

a) providing a ball guide embedded in said obstacle, where said obstacle is shaped like a standing animal with the body thereof raised above a final section of a course with a body appendage pivotably mounted to said body, said appendage disposed to make contact with an initial section of a course, b) propelling the golf ball into an opening in said appendage in contact with said initial course section such that the ball comes to rest in said appendage, c) pivoting said appendage such that the ball is raised to a height sufficient for gravity to cause said ball to roll through said ball guide and exit said obstacle;

whereby said ball appears to exit said obstacle on to said final section of the course.

* * * * *